US008684045B1

(12) United States Patent
Moehle

(10) Patent No.: US 8,684,045 B1
(45) Date of Patent: Apr. 1, 2014

(54) SYSTEM FOR FILLING RESEALABLE BAGS

(76) Inventor: Russell Paul Moehle, Dallas, TX (US)

( * ) Notice: Subject to any disclaimer, the term of this patent is extended or adjusted under 35 U.S.C. 154(b) by 38 days.

(21) Appl. No.: 13/430,647

(22) Filed: Mar. 26, 2012

Related U.S. Application Data

(60) Provisional application No. 61/504,338, filed on Jul. 5, 2011.

(51) Int. Cl.

| | |
|---|---|
| ***B65B 1/04*** | (2006.01) |
| ***B65B 67/04*** | (2006.01) |
| ***B65B 1/18*** | (2006.01) |
| ***B65B 67/12*** | (2006.01) |

(52) U.S. Cl.
CPC .. *B65B 1/18* (2013.01); *B65B 67/12* (2013.01)
USPC ..... 141/10; 141/114; 141/247; 141/314; 141/316; 248/95; 248/99; 248/101

(58) Field of Classification Search
USPC ..... 141/10, 114, 247, 314–316, 234–245; 269/152; 248/95, 99–101
See application file for complete search history.

(56) References Cited

U.S. PATENT DOCUMENTS

| | | | | | |
|---|---|---|---|---|---|
| 861,007 | A | * | 7/1907 | Wilhelm | 141/312 |
| 4,537,377 | A | * | 8/1985 | Shewchuk | 248/99 |
| 4,974,746 | A | * | 12/1990 | Dickinson | 220/495.09 |
| 5,058,763 | A | * | 10/1991 | Dickinson | 220/495.09 |
| 5,467,949 | A | * | 11/1995 | Lemke | 248/95 |
| 5,496,087 | A | * | 3/1996 | Lathrop | 294/137 |
| 5,797,567 | A | * | 8/1998 | Magnafici | 248/97 |
| 5,813,444 | A | * | 9/1998 | Cashion | 141/248 |
| 6,007,030 | A | * | 12/1999 | Judge | 248/95 |
| 6,105,640 | A | * | 8/2000 | Holand et al. | 141/391 |
| 6,460,814 | B1 | * | 10/2002 | Bolick | 248/95 |
| 6,843,453 | B1 | * | 1/2005 | Rogers | 248/99 |

* cited by examiner

*Primary Examiner* — Timothy L Maust
(74) *Attorney, Agent, or Firm* — Jeffrey Roddy

(57) ABSTRACT

A means for retaining a resealable bag in an open position for filling purposes is described which includes a surround having an interior dimension less than a nominal width of one side of an unfilled and sealed bag. A pair of cut-outs formed into the surround are shaped and sized to guide edges of a bag during insertion into the surround, retain the upper corners of the bag to prevent axial movement of the bag once inserted, and bias the mouth of the bag in a open position to receive contents.

7 Claims, 14 Drawing Sheets

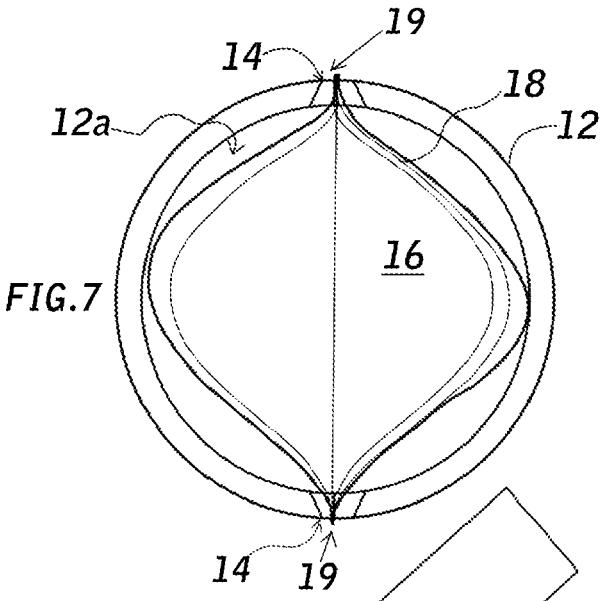
FIG.7
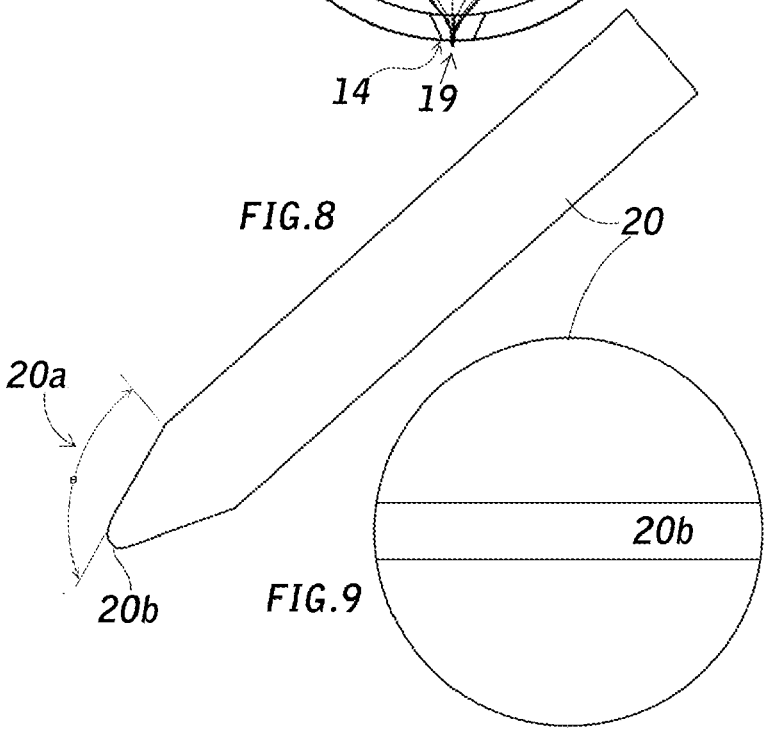
FIG.8
FIG.9

FIG.17
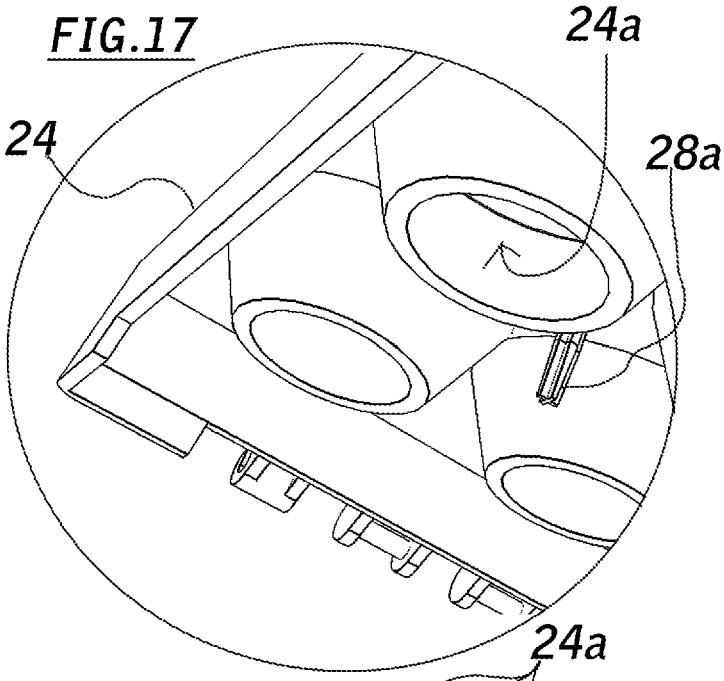
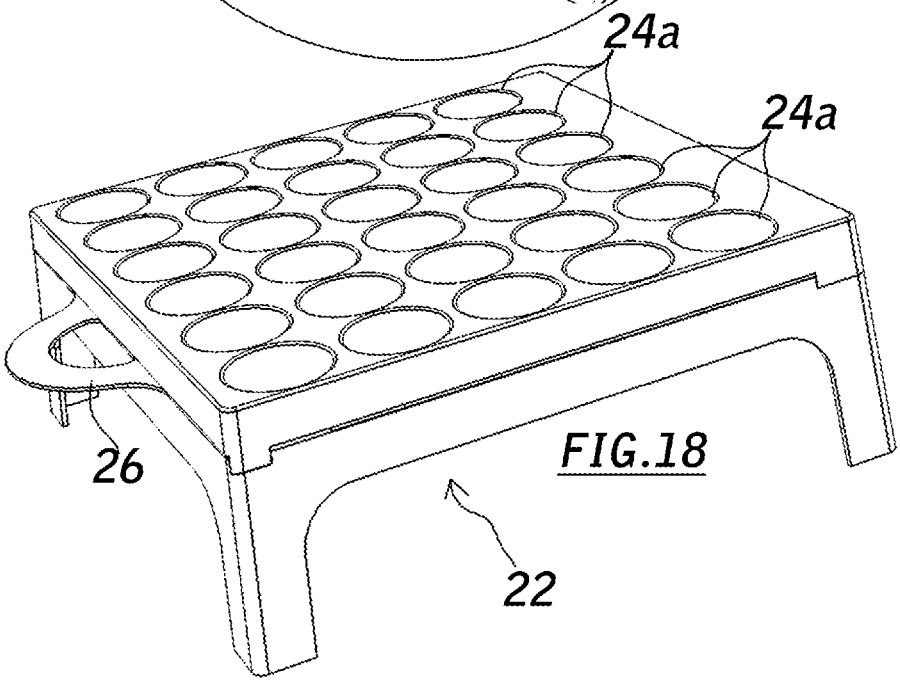
FIG.18

26
24
22

28
26
28
26a
26b
26b
24
26a
22
26a
26b
28
26b
26a
22
12a
12a
12a
12a
12a
12a

SYSTEM FOR FILLING RESEALABLE BAGS

CROSS REFERENCE TO RELATED APPLICATIONS

This application claims the benefit of Provisional Patent Application No. 61/504,338 filed Jul. 5, 2011.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

FIELD OF THE INVENTION

The present invention relates generally to means for holding a bag in an open position for filling, and more specifically to a means for biasing a freezer bag, or Ziploc® type bag in an upright and open position for filling.

BACKGROUND OF THE INVENTION

Resealable bags, also known as freezer bags or Ziploc type bags come in a variety of designs, but share the feature of being resealable between uses. Typically, such bags have a closure means such as a trough or groove on one side of the opening reversibly couplable to a ridge on the other side. This particular construction, because of the typical corrugations forming the couplable portions, results in a bag with greater stiffness and less flexibility about the opening than in other regions of the bag. The couplable portions resist crumpling, whereas the other regions of the bag crumple easily.

Various means of holding a resealable bag in an open position have been described. U.S. Pat. No. 5,275,363 to Dennis, teaches a spring loaded clamp with opposing arms that hold such a bag in an open position.

While no doubt the foregoing invention works for its intended use, it would be desirable to provide a system that could be used in various bag filling operations. It would be most desirable to provide a bag holding system that can scale from a single bag to multiple bags supported in an open position in a series.

SUMMARY OF THE INVENTION

The present invention is a system for holding a resealable bag in an open position using the natural tendency of a resealable bag to resist deformation about the opening. The invention includes at least a generally tubular surround with at least one open end, and having two opposing cut-outs or indentations at an open end of the tubular surround. While in the particular embodiment depicted herein the tubular surround is generally a cylindrical channel, it is conceivable, although less desirable that the surround be of another shape and accordingly other profiles such as an elliptical channel or rounded rectangular channel are intended to be encompassed by the present invention. Although the cut-outs of within the surrounds are depicted as typically v-shaped, other tapering shapes will suggest themselves to those having skill in the art. Accordingly, it is not intended that the surround and cut-out portions of the invention be limited to the particular shapes depicted herein.

In one aspect of the present invention, the surround is a section of cylindrical plastic tubing, channel or pipe having a inside diameter (ID) less than the width of an unfilled resealable bag as measured when the bag in a flat position. The cut-outs provide a seat for the upper corners of the resealable bag when the bag is inserted into the surround. Because the surround possesses an ID less than the bag width as described above, the bag, once inserted, is held in an open position due to biasing that occurs about the bag opening that corresponds to the coupling means when the bag is inserted into the surround. Each of the cut-outs are widest at the top of the surround and taper inwardly. The taper terminus can be somewhat rounded or a vertex of adjacent sides of the tapered cut-out. The surround can be closed at one end or open at both ends.

In another aspect of the present invention, a method is described whereby a bag is filled by initially inserting the bag into a surround by means of a plunger, whereupon the corners of the bag are seated within the cut-outs and the bag is held therein in an open position for filling.

In yet another aspect of the invention, more than one surround is grouped together by means of a frame so that multiple bags can be filled at the same time. A funneling means is positioned above the surround, with a shielding means moveable between the opening of the surround/bag and the funneling means.

In order to use the system, a surround is selected having an ID appropriate for a particular width of resealable bag, or a range of bag widths. Preferably, a chart (not shown) accompanies the system which assists in matching surrounds to bag width. The surround; either singly, or a group of surrounds, is placed on a flat surface with the opening(s) facing up. A resealable bag is inserted into the surround so that the uppermost corners of the bag are seated within the cut-outs. A means for inserting an open bag into the surround is provided for use with the system which can be a plunger 20 that is initially inserted partway into an open bag prior to insertion into the surround and after which, the bag with plunger are inserted into the surround. The corners of the bag are then retained by the cut-outs and the plunger is withdrawn leaving the bag in place. The bag may be placed on the plunger manually, or automated means (not shown) may be used to insert the plunger into the bag opening. Regarding the shape of the plunger, it is preferable that a tapered end 20*b* of the plunger be slightly blunted to avoid damaging the bag. Taper angle 20*a* can be any angle to best facilitate placement in the bag interior. The bag, now secured within the surround open position via the biasing provided by the surround can be filled. Once filled, the bag can be removed from the surround and sealed, or remain in place for additional filling operations.

The present invention provides a means for filling a plurality of bags concurrently with an identical grouping of contents. The invention is useful for concurrently packaging disparate items which are packaged together for any particular purpose; for example, packages of hardware items and fasteners used for home assembly of purchased items, candy sample bags, wildflower seeds, and for individuals having a complicated daily dose regime of medications, whereby a series of bags containing a daily dose regime can be filled at the same time with contents drawn from different containers. It is to this last use, that several non-limiting examples disclosed herein are directed.

BRIEF DESCRIPTION OF THE DRAWINGS

FIG. 7 is a top plan view of the surround 12 depicting biasing of a held bag 16 within annulus 12*a* with a chamfered cut-out 14;

FIG. 8 is a side view of an exemplary plunger 20 useable with the current invention;

FIG. 9 is an end view of the plunger shown in (FIG. 8);

FIG. 17 is a detail view of a single funnel 24*a* of the funneling means 24 shown in (FIG. 16) and registration tab 28*a* extending from the underside of the funneling means;

FIG. 18 is a perspective view of one embodiment according to the present invention showing funneling means 24 attached atop the frame having a series of surrounds 22;

DETAILED DESCRIPTION OF THE INVENTION

Reference Listing

Figure 1:
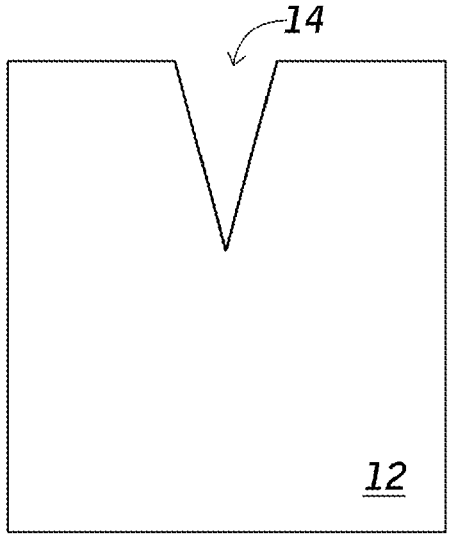
FIG. 1 is a side plan view of a surround 12 for use with the present invention.
Figure 2:
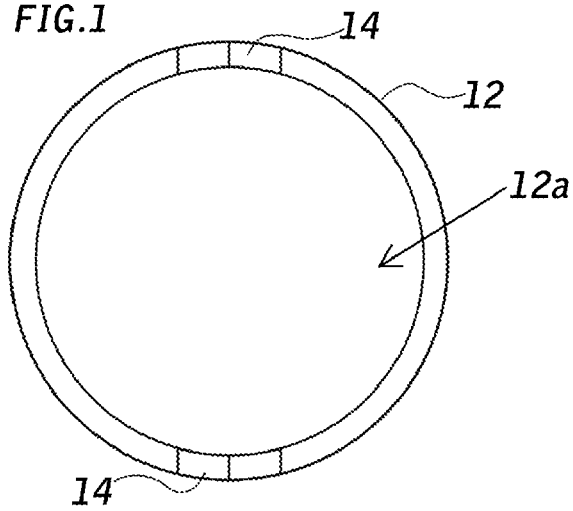
FIG. 2 is a top plan view of the surround 12 of (FIG. 1)
Figure 3:
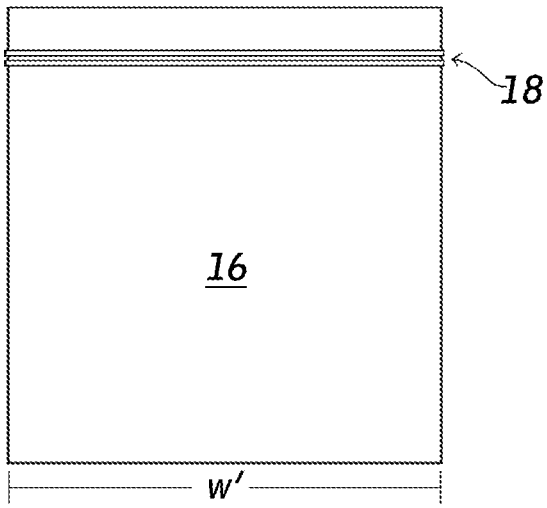
FIG. 3 is a side plan view of a typical resealable bag 16 with coupling means 18.
Figure 4:
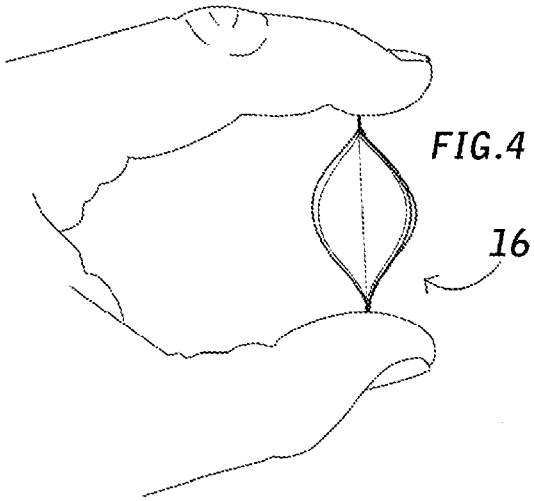
FIG. 4 is a perspective view demonstrating the biasing of the resealable bag 16 of (FIG. 3) in an open position.
Figure 5:
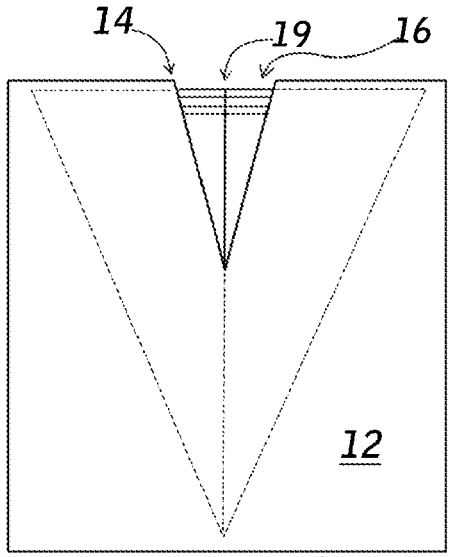
FIG. 5 is a side plan view of the surround 12 of (FIG. 1) containing a resealable bag 16.
Figure 6:
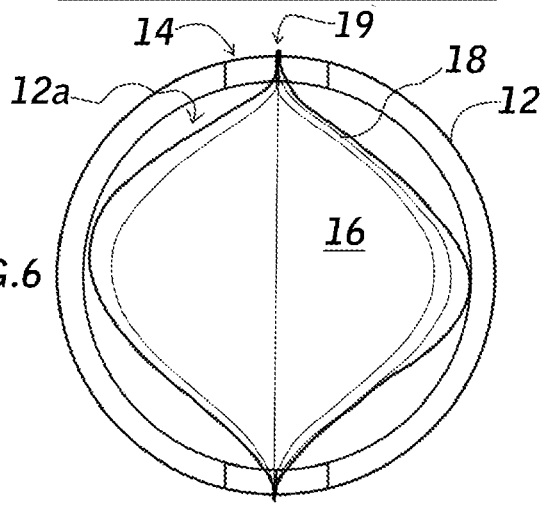
FIG. 6 is a top plan view of the surround 12 depicting biasing of a held bag 16 within annulus 12*a* with corner and seam 19 nested within the cut-outs 14.
Figure 10:
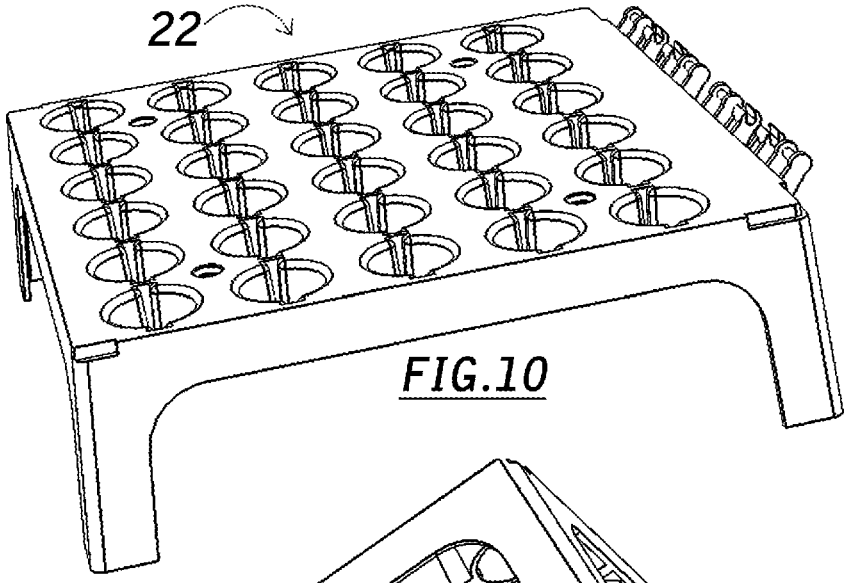
FIG. 10 in a perspective view depicts an embodiment according to the present invention having a series of surrounds 22 formed within a supportive frame.
Figure 11:
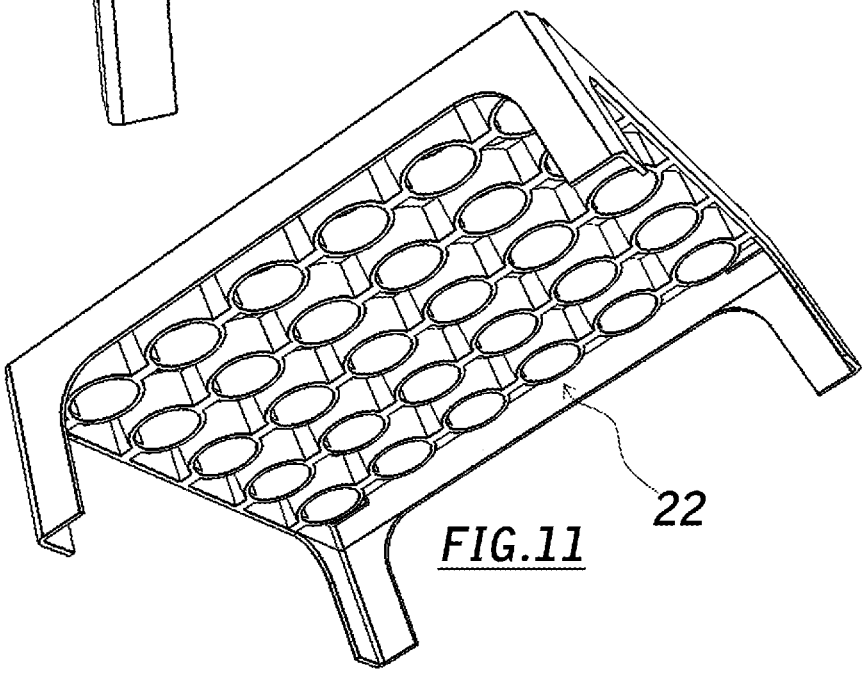
FIG. 11 depicts the underside of the embodiment shown in (FIG. 10)
Figure 12:
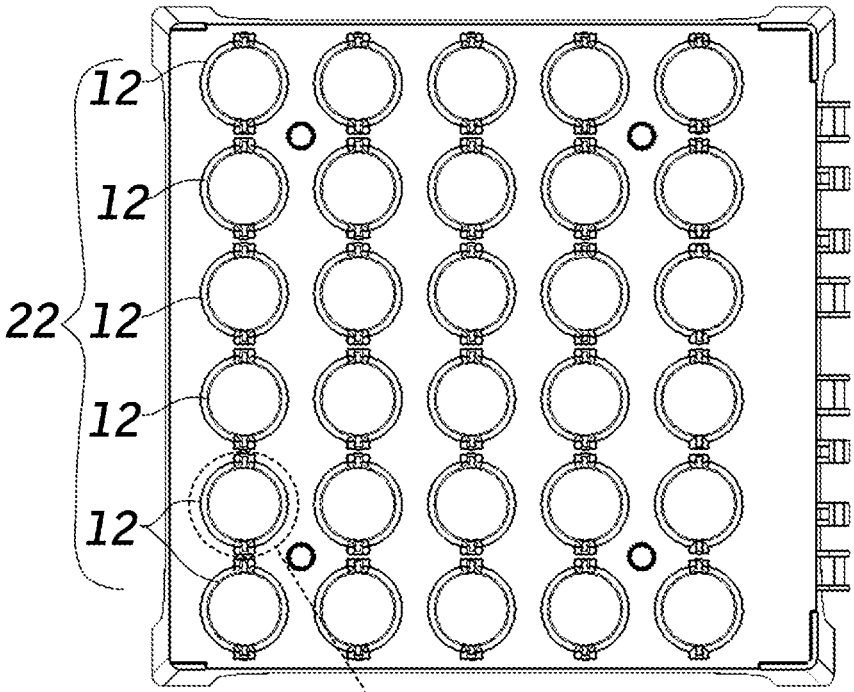
FIG. 12 is a top plan view of the embodiment of (FIG. 10)
Figure 13:
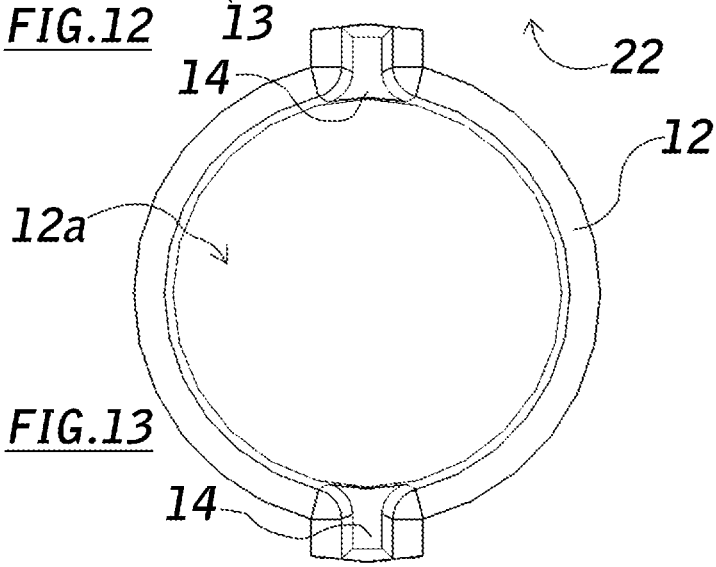
FIG. 13 is a detail view of an individual surround 12 with annulus 12*a* taken from a series of surrounds 22 formed within a frame shown in (FIG. 12)
Figure 14:
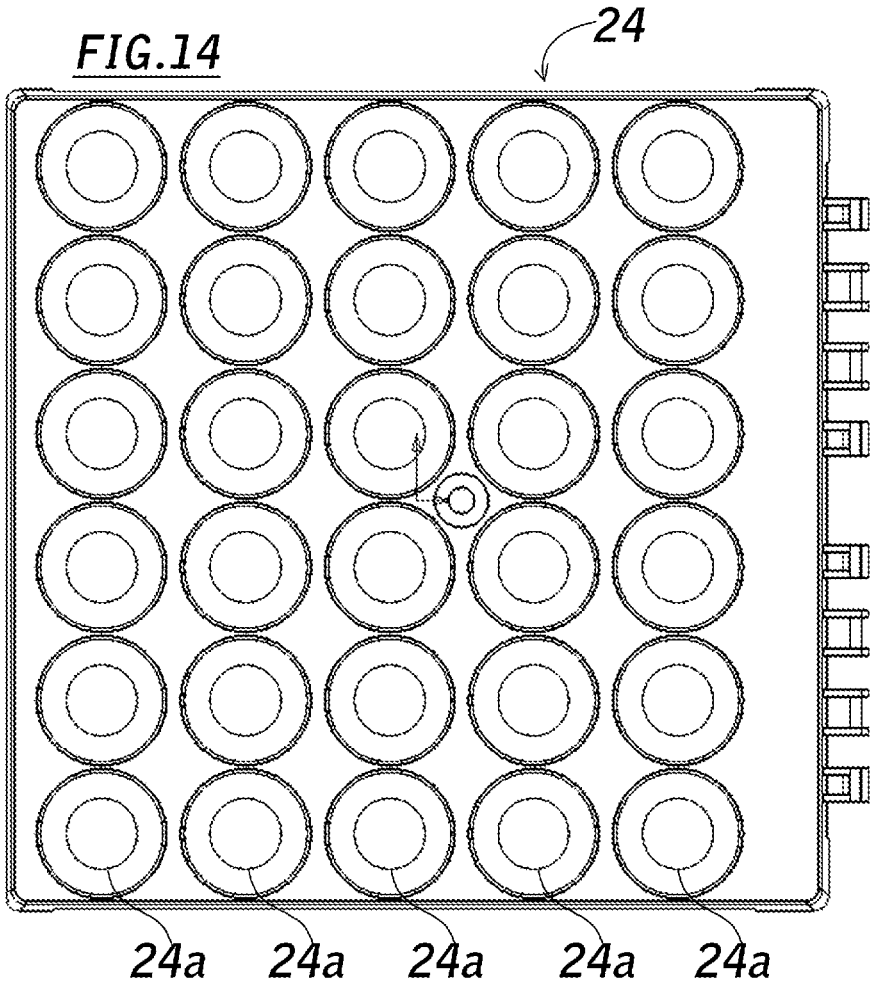
FIG. 14 is a top plan view of a funneling means 24 having a series of funnels 24*a* which is removably positionable above the surrounds shown in (FIG. 10)
Figure 15:
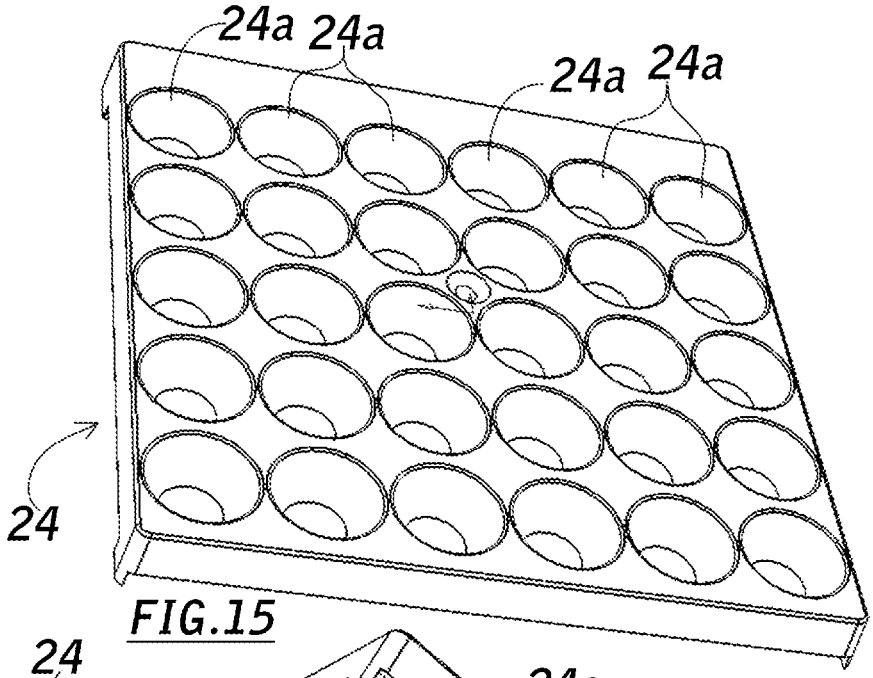
FIG. 15 is a top perspective view of the funneling means 24 depicted in (FIG. 14)
Figure 16:
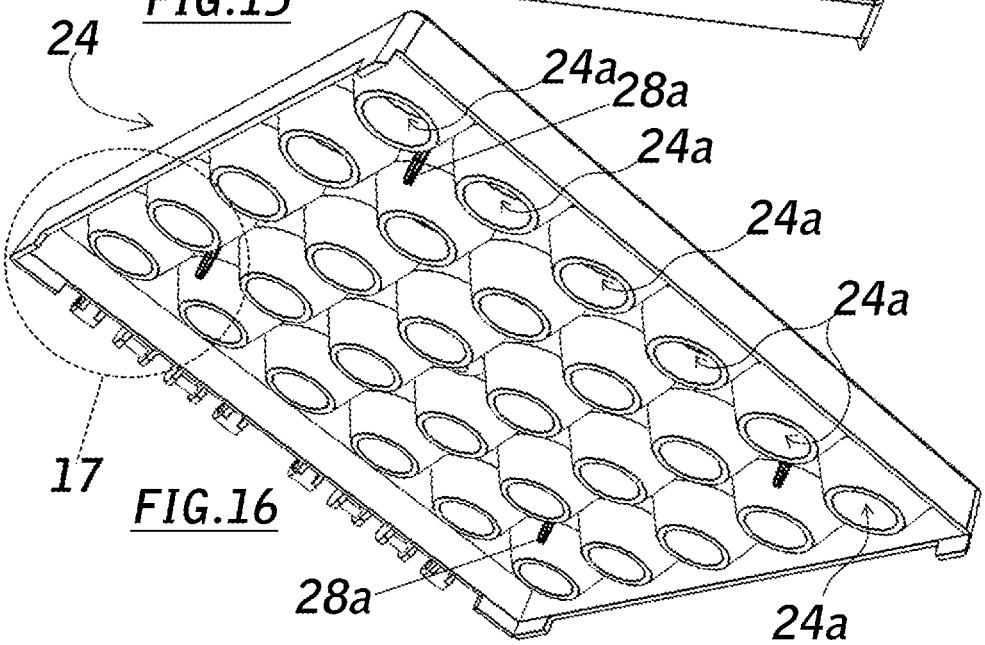
FIG. 16 depicts an underside of the funneling means shown in (FIG. 15)

12 surround
12*a* surround annulus
14 cut-out
16 resealable bag
18 coupling means
19 bag corner and seam
20 plunger
22 surround series
24 funneling means
24*a* funnel aperture
26 shielding means
26*a* shield aperture
26*b* registration slots
28 registration tabs
28*a* registration pegs
w' resealable bag width

DEFINITIONS

In the following description, the term "series" refers to any number of "surrounds" greater than one, grouped or held together in a frame for filling purposes. Unless otherwise explained, any technical terms used herein have the same meaning as commonly understood by one of ordinary skill in the art to which this disclosure belongs. The singular terms "a," "an," and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." Publications, patent applications, patents, and other references mentioned herein, if any, are incorporated by reference in their entirety for all purposes. In case of conflict, the present specification, including explanations of terms, will control. In addition, the materials, methods, and examples are illustrative only and not intended to be limiting.

Referring generally to FIGS. 1-9; a preferred embodiment of a system for holding a resealable bag in an open position includes a surround 12 which is typically a length of cylindrical tubing, having a pair of cut-outs 14 in the side wall of the surround. The cut-outs are preferably v-shaped and tapering. The inside diameter of the surround is less than the width of the resealable bag intended for holding, so that once a bag 16 is inserted so that the corners with seams 19 are seated within the v-shaped cut-outs, (1) the bag is biased in an open position, and (2) the bag is at least supported by the bottom edge of the cut-out residing underneath an edge of coupling means 18 of the bag 16.

The cut-outs taper so that the bag can be guided easily into a seated position for support and filling purposes. The v-shaped cut-outs may be perpendicular to the surround, or angled so that the dimensions of the outwardly exposed profile of the cut-out may be larger or smaller than the inwardly exposed profile of the cut-out. Preferably, each v-shaped cut-out may be chamfered toward the center of the surround so that a sharper edge is created on the exterior face of the surround, and a flared edge created on the interior face of the surround so as to accommodate the bulge created at the bag corners by the zippered opening.

An example of resistance to deformation and crumpling found in resealable bags is depicted in (FIG. 4) in which the seam portion along with the thicker coupling portions of the bag, resist deformation and permit the bag to be biased in an open position by forcing the uppermost corners of the bag together.

Any suitable material may be used in the construction of the surround; including, but not limited to plastics, metals, paperboard and glass. The cut-outs may be mechanically removed from a tubular member, or formed in situ by injection molding or other common processes. The invention is not limited by a particular brand or manufacture of resealable bag; the characteristics of which are generally similar enough to work well with the invention.

A series of surrounds is depicted in FIGS. 10-13 being formed within a framework. Although preferably, the frame has legs for self support, it will be appreciated by those having skill in the art that the frame with surrounds can be used as a sub-element part of a larger packaging system. The surrounds 12 can be molded unitarily with the frame, or can be removed from the frame as individual elements. Conceivably, a frame can comprise a series of apertures into which the surrounds are removably placed, forming a grouping or series of surrounds 22, and the surrounds can have differing internal dimensions while maintaining a uniform outside dimension in order to fit into frame apertures.

FIGS. 14-17 depict a funneling means 24 which possesses a series of funnels having an frustroconical shape and apertures 24*a*. When filling bags held by the surrounds 22, the funnel apertures 24*a* are coaxially aligned with the surround openings. While the particular embodiment shown depicts the funneling means as being hingeably attached to the frame and the truncated ends of the funneling means separated from the open ends of the surround by a space, other alignment means for positioning the funneling means into a filling position will suggest themselves to those skilled in the art. Accordingly, any common alignment means is considered to be encompassed by the invention. For example, the funneling means can be situated above the surrounds with any attachment means or no attachment means to the surround or frame, if any is present.

Figures 19, 20:
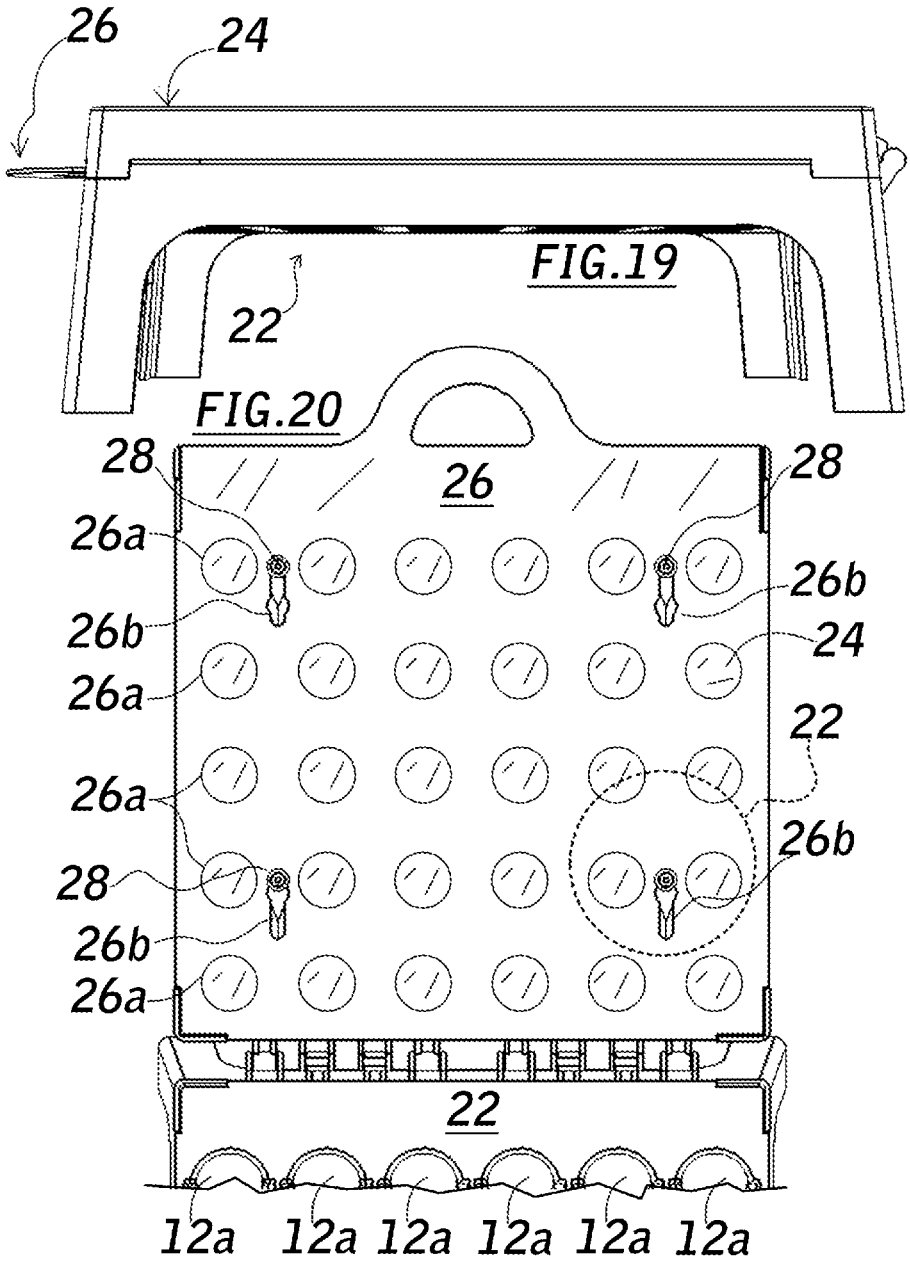
FIG. 19 is a side elevation of the hingeably attached frame and funneling means 24 shown in (FIG. 18)
FIG. 20 in top partial view, depicts the hingeably attached frame and funneling means in an open position with a shielding means 26 adjacent the funneling means 24, and positioned between the funneling means and the series of surrounds 22 when the assembly is in a closed position previously shown in (FIG. 18)
Figure 21:
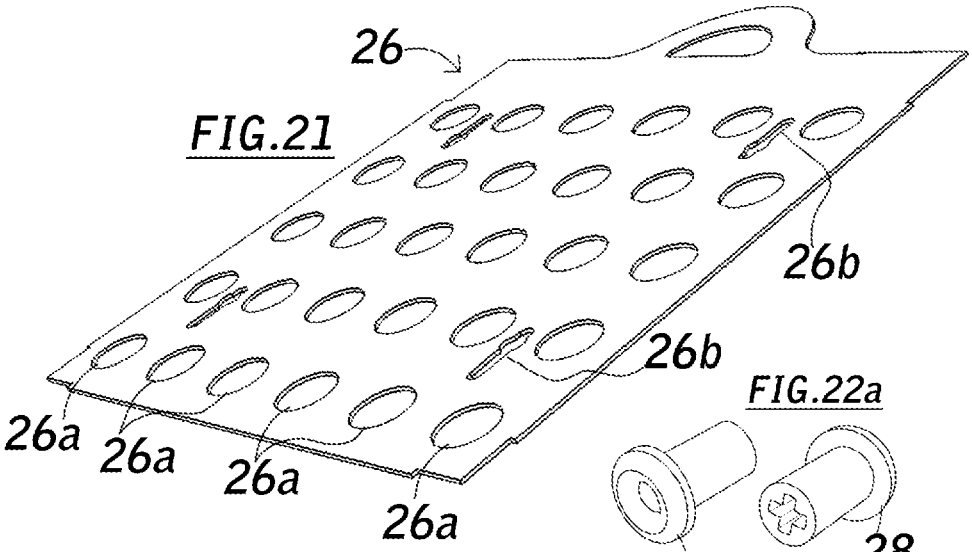
FIG. 21 is a perspective view of the shielding means 26 of (FIG. 20) when separated from the frame.
Figure 22A:
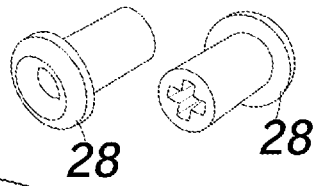
FIG. 22*a* is an enlarged perspective view of the registration tab which in the particular embodiment is shaped somewhat like a bolt with a top of relatively larger diameter. The tab has a cross-shaped aperture passing longitudinally through the tab.
Figure 22:
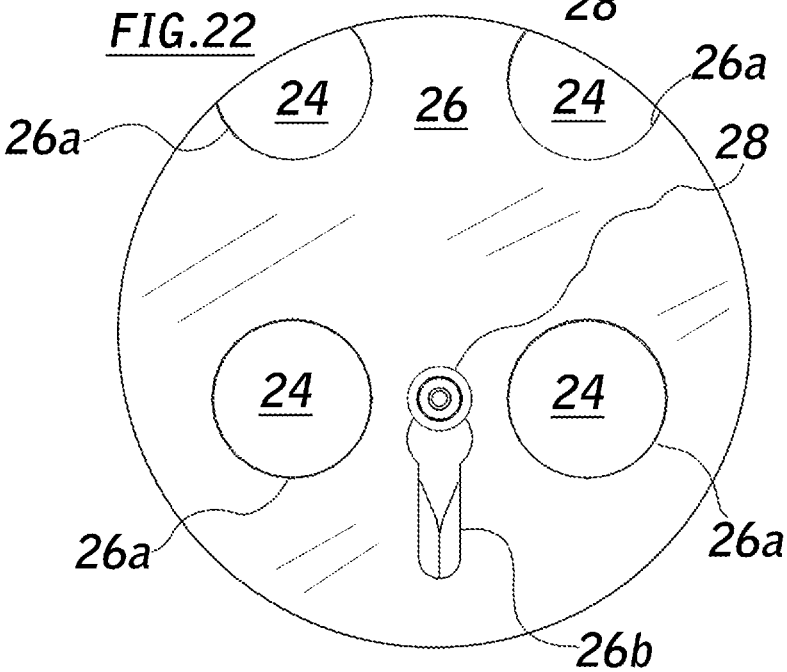
FIG. 22 is a detail view showing the shielding means 26 of (FIG. 20) slidably interlocked with the funneling means 24 by means of registration tabs 28 where the apertures of shielding means 26*a* are slidably positioned in a space corresponding to the regions between the funnel apertures 24*a;*
Figure 23:
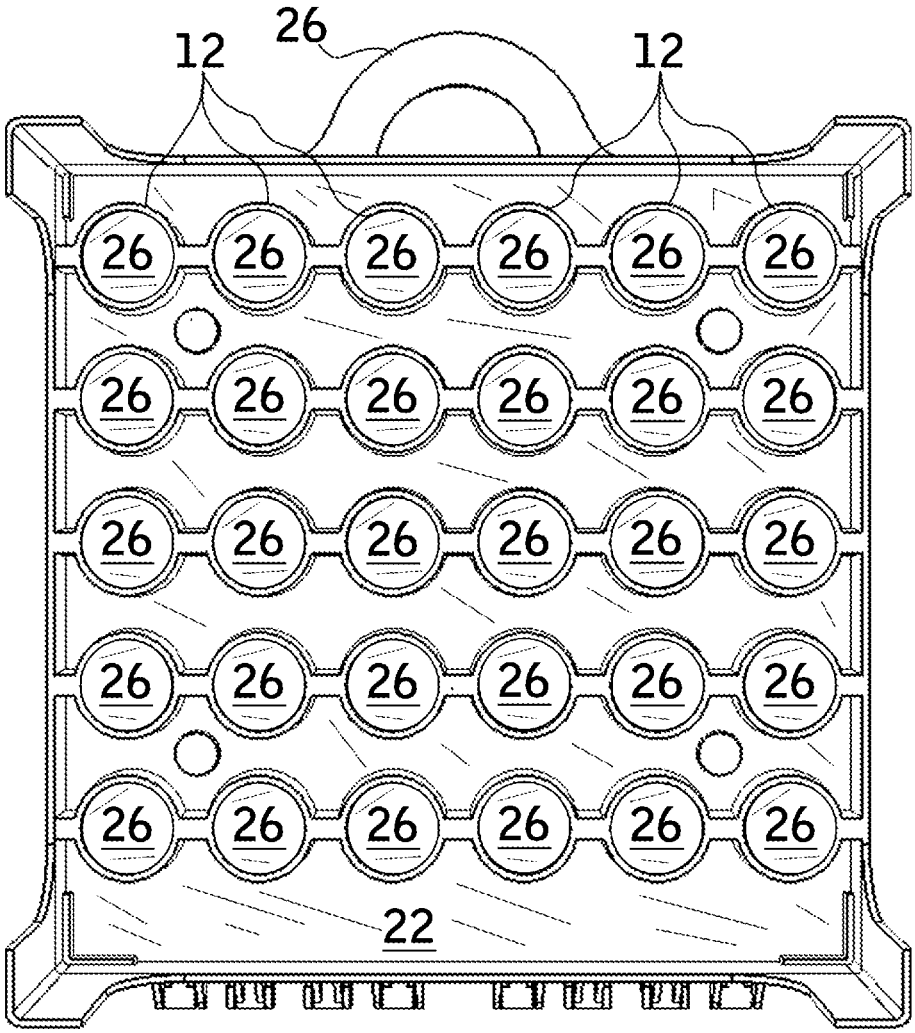
FIG. 23 shows is a bottom perspective view showing the shielding means 26 of (FIG. 20) slidably interlocked with the funneling means, and positioned where solid sections of the shielding are simultaneously occluding the surround apertures and the funnel apertures.
Figure 24:
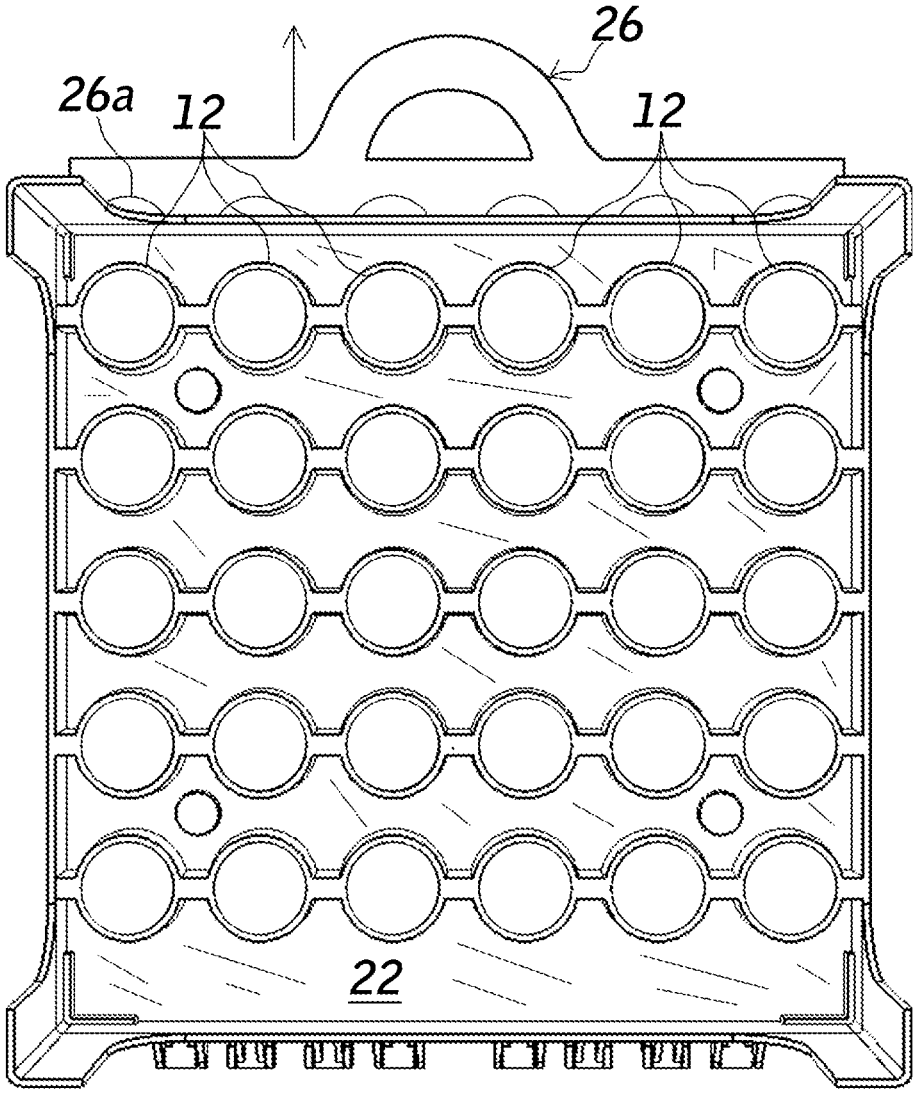
FIG. 24 shows the shielding means of (FIG. 20) slidably interlocked with the funneling means, now slid outwardly, and positioned where apertures of the shielding means 26 are coaxially aligned with the surround apertures 22 and the funnel apertures (not visible)

FIGS. 18-22 depict a preferred embodiment according to the present invention in which the funneling means 24 is brought into alignment with the series of surrounds 22 formed in the frame by a hingeable connection. A generally planar shielding means 26 having apertures 26*a* with solid regions between the apertures is positioned between the funneling means and the surrounds. Each surround annulus 12*a* and each funnel aperture 24*a* is brought in and out of coaxial alignment during a filling operation. The shielding means is slidably moved between a closed position in which solid regions of the shielding means are occluding the openings of the surrounds, and an open position in which the apertures of the shielding means are coaxially aligned with the funnel apertures 24*a* and the surround apertures. Preferably, the shielding means is retained in a slidable configuration by registration tabs 28 which reversibly couple the shielding means to the underside of the funneling means. The registration tabs resemble round headed pins having a longitudinal cross-shaped through-aperture which is reversibly mated to correspondingly shaped pegs 28*a* formed into the underside of the funneling means. The heads of the tabs face outwardly and toward the open ends of the surrounds when the shielding means is coupled to the funneling means, with the lesser diameter portion of the registration tabs passing through, and residing within slots formed into the funneling means to provide a guiding means for slidable movement. FIG. 19 is a side elevation showing from top down, the hinged funneling means 24, shielding means 26, and surrounds 12. FIG. 20 is a view that shows the funneling means with affixed shielding means 26 completely pivoted away from the surrounds exposing the top of the surround series 22. The relationship between the slidable positions of the shielding means relative to the apertures of the funneling means and the series of surrounds can be seen in FIGS. 23 and 24 which both depict a bottom perspective view of the assembly. In FIG. 23 the shield is in a closed position blocking passage between the surround apertures and the funnel openings. In FIG. 24 the shield has been slid outwardly by means of a handle portion, thereby placing the shield apertures into coaxial alignment with both the surround apertures and the funnel openings permitting objects to pass from the funnels into bags which would normally be held in an open position by the surrounds. The shielding means can be made of any suitably rigid material, preferably of a opaque dark color so that items placed thereon can readily be seen and differentiated.

Figure 25:
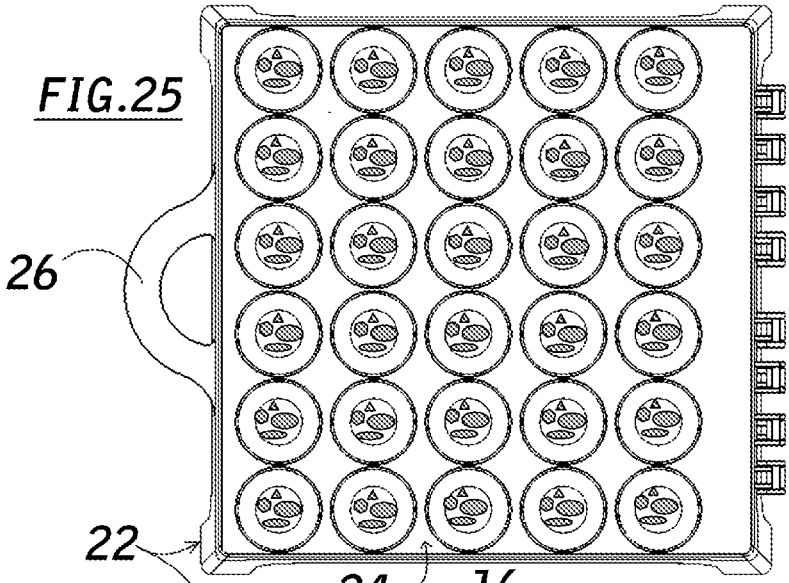
FIG. 25 is a top perspective view of the system depicted in (FIGS. 19-20) in which a series of objects have been placed within the funneling means and supported by the shielding means when in a position blocking passage between the funnels and the surrounds.
Figure 26:
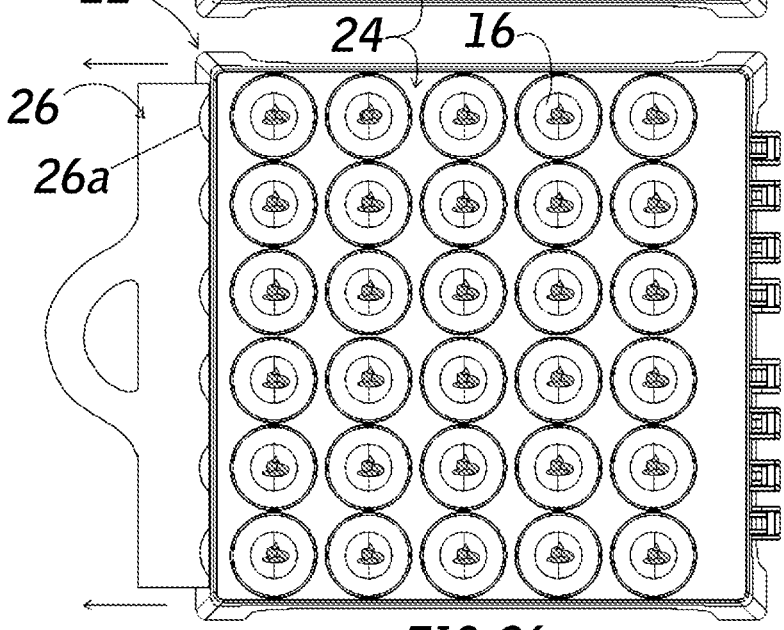
FIG. 26 is a top perspective view of the system depicted in (FIG. 25) in which the shielding means has been slid into a position permitting passage between the funnels and the surrounds, and thereby depositing the objects into bag openings.

Moving to the top perspective views of FIGS. 25 and 26, a stepwise example for filling a series of bags is shown following the insertion of a bag into each surround within the series. FIG. 25 shows the funneling means 24 positioned above the series of surrounds 22, with shielding means 26 in a position blocking passage between the surround openings and the funnels. A number of miscellaneous items have been placed within the apertures 24*a* of the funneling means and are supported therein by the solid regions of the shielding means. In FIG. 26 the shielding means has moved to a position in which the apertures of the shielding means are now aligned with the surround/bag openings, permitting the miscellaneous items to fall into the bags. The bags, now filled, are ready to be removed, or retained in place for additional filling operations.

While the invention has been described by the embodiments given, it is not intended to limit the scope of the invention to the particular forms set forth. Accordingly, the description herein is intended to cover such alternatives, modifications, and equivalents as may be included within the spirit and scope of the invention as defined by the appended claims.

What is claimed is:

1. A system for filling a bag with a plurality of items reflecting a desired collection of items comprising:

1) at least one resealable ziplock type bag with a mouth, a coupling means, and a nominal width as measured when the bag is in an unfilled state, 2) at least one surround having a pair of cut-outs oppositely positioned and formed in an open end of the at least one surround having at least one inside diameter less than the nominal width of the bag, and wherein each cut-out defines a guide for bag insertion and a seat to loosely support an outer edge of the coupling means when the bag is fully inserted into the surround thereby biasing the mouth of the bag in an open state by inducing inside edges of the upper corners of the bag toward one another.

2. The system according to claim 1 in which the bag is inserted into the surround in an unsealed condition.

3. The system according to claim 1 in which the at least one surround creates a series of adjoining surrounds.

4. The system according to claim 1 further comprising a funneling means having apertures and solid portions between the apertures, with the apertures generally aligned with the surround openings.

5. The system according to claim 1 further comprising a shielding means having apertures and solid portions between the apertures capable of assuming an open and closed position relative to the surround openings.

6. A method for depositing a predetermined collection of items in at least one resealable ziplock type bag comprising the steps of:

1) providing at least one surround having at least one interior diameter of less width than the at least one bag when in an unfilled and sealed condition, and, a pair of cut-outs oppositely positioned and formed in an open end of the at least one surround, with each cut-out defining a guide for bag insertion and a seat for an upper corner of the bag, 2) inserting the bag into the surround so that vertical edges of the bag align with the cut-outs and upper corners of the bag are loosely retained by the cut-outs thereby inducing the upper corners toward one another, 3) filling the at least one bag with contents, 4) removing the at least one bag from the at least one surround.

7. A system for concurrently filling a plurality of ziplock type resealable bags, each with a desired grouping of items comprising:

1) a series of surrounds, each surround having a pair of cut-outs oppositely positioned and formed in an open end of the surround, in which each cut-out defines a guide for bag insertion and a seat to loosely retain an upper corner of the bag when fully inserted into the surround, and, wherein an inside diameter of each surround is less than a nominal width of the bag when it is in a sealed and unfilled condition, 2) a segregation means for visually confirming contents of groupings prior to concurrent depositing in each bag, and, 3) a shielding means for concurrently depositing the groupings into corresponding bags by gravity wherein the bags are maintained in an open state for filling by inducing upper corners of the bag toward one another.

* * * * *